US005185101A

United States Patent [19]

Weipert

[11] Patent Number: 5,185,101

[45] Date of Patent: Feb. 9, 1993

[54] COMPOSITIONS CONTAINING SALTS OF ACYLOXYALKANESULFONATES

[75] Inventor: Eugene A. Weipert, Kenosha, Wis.

[73] Assignee: Dr. Gene, Inc., Kenosha, Wis.

[21] Appl. No.: 745,144

[22] Filed: Aug. 15, 1991

[51] Int. Cl.[5] ..... C11D 1/28; C11D 1/72; C11D 1/68; C11D 1/831

[52] U.S. Cl. ..... 252/554; 252/170; 252/174.21

[58] Field of Search ..... 252/551, 170, 174.21, 252/554

[56] References Cited

U.S. PATENT DOCUMENTS

| | | | |
|---|---|---|---|
| 4,234,464 | 11/1980 | Morshauser | 252/550 X |
| 4,790,956 | 12/1988 | Weipert et al. | 252/538 |
| 4,941,990 | 7/1990 | McLaughlin | 252/121 |
| 5,076,953 | 12/1991 | Jordan et al. | 252/108 |
| 5,096,608 | 3/1992 | Small et al. | 252/132 |

*Primary Examiner*—W. J. Shine
*Assistant Examiner*—Douglas J. McGinty

[57] ABSTRACT

This invention discloses compositions consisting essentially of a major amount of a salt of an acyloxyalkanesulfonate and a minor amount of a saturated aliphatic alcohol mixture. These compositions are readily converted into non-dusting, free-flowing flakes that are ideally suited to the preparation of detergent formulations.

9 Claims, No Drawings

COMPOSITIONS CONTAINING SALTS OF ACYLOXYALKANESULFONATES

DESCRIPTION OF THE INVENTION

The present invention relates to the preparation and handling of surface active agents. More particularly, it relates to surface active compositions based on salts of acyloxyalkanesulfonates of the general formula $RCOOR'SO_3M$, where R is a monovalent aliphatic hydrocarbon radical having from 5 to 19 carbon atoms, R' is a divalent hydrocarbon radical having from 2 to 4 carbon atoms, and M is sodium potassium or ammonium. These salts, also known as acylisethionates (in particular, sodium cocoylisethionate), are commonly used in syndet bars to impart mildness and rinsability.

When produced by conventional methods (U.S. Pat. Nos. 1,932,180 and 4,515,721), the product is a finely divided powder and gives off air-borne dust that is highly irritating to personnel working with it. In order to avoid this problem, the product can be produced with substantial amounts of free coconut fatty acid (U.S. Pat. No. 2,923,724), or the coconut fatty acid can be largely replaced by stearic acid (U.S. Pat. Nos. 3,320,292 and 3,420,857). In either case the substantial amount of free fatty acid dilutes the active agent and negates the rinsability of the acylisethionate.

I have found that a high active agent concentrate, that is easily handled in the molten state and readily forms crisp, nondusting flakes, can be prepared from acyloxyalkanesulfonate salts and a mixture of cetyl and stearyl alcohol (optionally with ethylene oxide adducts of this same alcohol blend). The alcohol/nonionic combination is commonly found in various creams and lotions used for skin care. This combination varies from about 50% alcohol to about 80% alcohol, the balance being water-soluble ethoxylated monohydric alkanols. These products are ethylene oxide adducts of a fatty alcohol or a mixture of fatty alcohols having 10 to 20 carbon atoms in the aliphatic carbon chain. The ethylene oxide content may vary from about 5 moles to about 50 moles, but the 15- to 25-mole adducts are preferred.

The preferred fatty alcohol mixture is about 30% cetyl alcohol and about 70% stearyl alcohol and is commonly referred to as hydrogenated tallow fatty alcohol. While this product can be produced from the natural source, it is also available from petrochemical processes, such as the Ziegler-Natta process.

As to the ratio of saturated aliphatic alcohol to acyloxyal kanesulfonate salt, the range of about 20:80 to about 50:50 is operable.

In the preparation of flakes of the composition of Cahn et al. (U.S. Pat. No. 3,320,292) or of Holland et al. (U.S. Pat. No. 3,420,857), one observes a gradual stratification if good agitation is not maintained since the two principal components are not miscible in the molten state. Such is not the case with the present invention. Further (perhaps because of the compatibility of the components), combinations with higher active anionic content can be handled in the melt and flaked.

The following examples illustrate the present invention, but numerous modifications and variations thereof will be apparent to those skilled in the art.

EXAMPLE 1

A mixture of 21 g. of ALFOL 1618T (Vista Chem. Co.), a mixture of about 30% cetyl alcohol and about 70% stearyl alcohol, with 9 g. of MACOL CSA-20 (PPG/Mazer Chem.), a 20-mole ethoxylate of the same alcohol blend, was heated to 150° C. while bubbling nitrogen through the molten material and stirring slowly. Over a 20-minute period, 70 g. of JORDAPON CI-UP (PPG/Mazer Chem. trade name for sodium cocoylisethionate) was added. This clear melt was cooled to 100° C. and poured onto aluminum foil. When cooled to room temperature, there resulted crisp, nondusting flakes of uniform composition.

EXAMPLE 2

A mixture of 210 g. of coconut fatty acid (Procter & Gamble C-108), 252 g. of 46% sodium isethionate solution, and 0.30 g. of zinc oxide was charged to a one-liter reaction vessel and stirred while sparging with nitrogen. The mixture was heated rapidly to 120° C. to remove the water in the sodium isethionate solution, then to 240° C. and held at that temperature for two hours. A mixture of 42 g. cetyl/stearyl alcohol and 18 g. MACOL CSA-20 was then added, and the excess coconut fatty acid distilled at about 10 mm Hg. The vacuum was relieved with nitrogen, the mixture was cooled to 120° C., and poured onto aluminum foil. Analysis by the traditional Epton methylene blue titration showed 65.7% anionic surfactant.

EXAMPLE 3

Fifty grams of ALFOL 1618T was stirred slowly at 150° C. while 150 g. of JORDAPON CI POWDER was added. When clear and uniform, the molten mass was poured onto aluminum foil.

EXAMPLE 4

Forty grams of the flakes from EXAMPLE 1 were dispersed into 60 g. of water at 50° C. When cool this dispersion had the consistency of "cold cream". Twenty grams of this dispersion was added to one gallon of warm (40° C.) water and 200 g. of Corriedale wool was thoroughly soaked with this dispersion, then rinsed with warm water and dried. The resulting fiber was carded then spun into yarn on a Louet spinning wheel. The spun yarn was unusually uniform with a luxuriant soft hand. The wheel operator felt neither harshness nor greasiness in handling the fiber.

Although the present invention has been described with reference to specific details of certain embodiments thereof, it is not intended that such detail should be regarded as limitations upon the scope of the invention except as and to the extent that they are included in the accompanying claims.

What is claimed is:

1. A composition consisting essentially of (a) between about 50 and about 80 weight percent of an acyloxyalkanesulfonate salt represented by the graphic formula:

$$RCOO(CH_2)_nSO_3M$$

where R is an aliphatic radical having from 7 to 17 carbon atoms, n is an integer from 2 to 4 inclusive, and M is sodium, potassium or ammonium and (b) from about 20 to about 50 weight percent of a mixture of saturated aliphatic alcohols having 12 to 18 saturated aliphatic carbon atoms.

2. The composition of claim 1 wherein the acyloxyalkanesulfonate salt is present in amounts of from about 60 to about 70 weight percent and the saturated aliphatic alcohol from about 30 to about 40 weight percent.

3. The composition of claim 2 wherein R is an aliphatic radical having from 7 to 17 carbon atoms and n is 2.

4. The composition of claim 3 wherein M is the sodium ion.

5. The composition of claim 2 wherein the acyloxyalkanesulfonate salt is sodium cocoylisethionate.

6. The composition of claim 1 wherein there is further added from about 1 to about 20 weight percent of ethoxylated monohydric alkanol represented by the graphic formula:

$$R'O(CH_2CH_2O)_mH$$

wherein R′ is an alkyl radical having from about 8 to about 18 carbon atoms and m is a number from about 5 to about 50.

7. The composition of claim 6 wherein m is a number from about 15 to about 25.

8. The composition of claim 6 wherein the amount of ethoxylated monohydric alkanol is from about 8 to about 12 weight percent.

9. The composition of claim 4 wherein the mixture consists of saturated aliphatic alcohols with 16 saturated aliphatic carbon atoms and saturated aliphatic alcohols with 18 saturated aliphatic carbon atoms.

* * * * *